US006144307A

United States Patent [19]

Elliot

[11] Patent Number: 6,144,307

[45] Date of Patent: Nov. 7, 2000

[54] MONITOR AND/OR OVERLOAD MEANS

[75] Inventor: Peter John Elliot, Hope Valley, United Kingdom

[73] Assignee: Street Crane Company Limited, United Kingdom

[21] Appl. No.: 09/119,376

[22] Filed: Jul. 20, 1998

[30] Foreign Application Priority Data

Jul. 22, 1997 [GB] United Kingdom ..... 9715293

[51] Int. Cl.[7] ..... G08B 21/00

[52] U.S. Cl. ..... 340/685; 340/665

[58] Field of Search ..... 340/685, 665

[56] References Cited

U.S. PATENT DOCUMENTS 3,737,888 6/1973 Cheze ..... 340/685
3,823,395 7/1974 Rigney et al. ..... 340/685
4,355,307 10/1982 Beck ..... 340/665
4,787,524 11/1988 Cobb, III et al. ..... 340/685

*Primary Examiner*—Glen Swann
*Attorney, Agent, or Firm*—Trexler, Bushnell, Giangiorgi & Blackstone, Ltd.

[57] ABSTRACT

A device which relates to the monitoring of things such as cranes and hoists and seeks to improve on known so-called capacity limiters or overload devices usually associated with the hoist or chain rope. A monitoring device for use with a crane or hoist having a drive roller with a drive shaft and a gearbox directly or indirectly attached to the drive shaft. The monitoring device includes a means of resisting rotational movement of the gearbox located between the gearbox and an adjacent rigid structure, the means between the gearbox ad the adjacent rigid structure being such as to allow a limited degree of movement of the gearbox, and there being a means to react to the movement of the gearbox associated with the means of resisting rotational movement.

12 Claims, 3 Drawing Sheets

MONITOR AND/OR OVERLOAD MEANS

This invention relates to the monitoring of and the prevention of the overloading of such as for example the rope drums of hoists and cranes, or the drive roller of conveyor systems.

BACKGROUND

With both hoists/cranes and conveyors they are designed to meet the exacting standards laid down by both British and International Standard Specifications inherent in which are the requirements regarding the safe working load that must be adhered to by the equipment at issue. If the safe working load or design capacity is exceeded, and particularly if it is exceeded repeatedly, it is not only inherently dangerous to operatives working in proximity to the equipment but also is a frequent cause of major breakdowns to the inconvenience and the cost of the user.

Historically, many attempts have been made to ensure that equipment of the kind mentioned above does not exceed its safe working load or design capacity, and a wide variety of rated capacity limiters (more usually referred to as "overload devices") have been proposed. With hoists/cranes they have for the most part been mechanical devices associated with the hoist/crane rope, and designed to react to the load on the rope. Also known to have been associated with the rope of hoists/cranes are linear transducers that also react to the load on the rope.

Other proposals have been to provide strain gauges by having a load cell linked direct to the load or a load pin fitted to a pulley of the hoist/crane or in the wheels of, e.g. a trolley for the movement of the hoist/crane on suspended tracks.

Predominantly, to date, such devices have only attended to the monitoring of the safe working loads.

OBJECT AND SUMMARY

The object of the present invention is to provide an effective means of ensuring that the safe working load of a hoist/crane, conveyor or the like is not exceeded, which means is readily adaptable to serve other important functions.

According to the present invention, a drive roller or drum having a gearbox directly or indirectly attached to its drive shaft, comprises a monitoring means formed by a means of resisting rotational movement of the gearbox located between the gearbox and an adjacent rigid structure, the said means between the gearbox and/or to the adjacent rigid structure being such as to allow a limited degree of movement of the gear box, and there being a means to react to said movement of the gearbox associated with the said means of resisting rotational movement.

The said means to react to rotational movement of the gearbox may be one or more micro switches to be operated by the rotational movement of the said gearbox, or may be a strain gauge on or in the said means to resist rotational movement of the gearbox. At the option of the user, both micro-switches and a strain gauge can be provided.

In one form of construction of the invention, the means to resist rotational movement of the gearbox is a torque arm attached at one end to an adjacent rigid structure, and at the other end to the gearbox, at a point on the gearbox distanced from the axis of the driven shaft of the drum or roller. Associated with the connection between the gearbox and the torque arm, and/or between the torque arm and the adjacent rigid structure, may be one or more micro-switches, calibrated to react to the load imposed on them by the rotation of the gearbox. Thus, at the commencement of operations of a hoist/crane or a conveyor, the degree to which the gearbox rotates is a direct function of the load on the hoist/crane or conveyor, and is translated directly into a rotational force on the gearbox. With a number of micro-switches present, each can be differently calibrated to give warnings that the safe working load of the equipment is being approached, so that the equipment can be switched off before any damage or excessive wear can occur, and cut the power to the motor as the safe working load is exceeded.

In a second form of construction, where again a torque arm is provided between the gearbox and an adjacent rigid structure, there is provided a strain gauge or load indicator located on the torque arm, or the torque arm can be constructed as a strain gauge or load indicator, and the essential purpose of affording a limited degree of rotational movement of the gear box is to ensure that the fore on the load on the gauge or indicator is at 90° to the line of action from the output shaft centre to the gearbox pivot centre line. Here, the application of the load to the hoist/crane or conveyor is constantly monitored, to allow the emitting of appropriate signals as the safe working load is approached, and to cut the power to the motor as the safe working load is exceeded.

Preferably, the micro-switches form part of a load indicator unit that may consist of a cast spheroidal graphite iron body having a means for its pivotal attachment to an adjacent frame, within which is a PTFE lined bush in which a steel piston is allowed to slide, the piston being connected to a plate associated with and able to activate a number of limit switches via adjusting screws. Preferably, behind the piston is a number of disc springs which serve to resist the force applied to the unit. Still further preferably, the piston is connected via a screw to a rod end joint that forms part of the pivot attached to the gearbox. It will be apparent that the pre-loading of the unit can be achieved by pre-loading the screw, and that the load indicator operates when a load applied to the springs causes their compression with resultant activation of the micro-switches to signal that a safe working load is being approached or has been surpassed.

In the form of construction embodying a strain gauge, it is preferred that it consists of a nominally flat bar of an appropriate metal provided with pivot forming holes at each end, and there being mounted along the length of the bar one or more strain gauge elements. It will be understood that a load applied to the bar (tensile or compressive) will strain the bar to cause an electric output from the strain gauge to provide an effective output signal suitably amplified by an appropriate amplifier. The output signal from the strain gauge can pass to a number of micro-switches that can themselves be within the amplifier to provide alarm or display signals or to emit a cutout signal to remove power from the equipment at the onset of an overload condition.

With either mechanically activated micro-switches or strain gauges/load indicators being employed, a data storage device can be provided, to receive signals from them to provide a record of the number of time that the safe working load has been approached or exceeded. If a data storage device is provided, other valuable information can be stored such as for example motor temperature, brake wear, number of start-ups, duration of operations, and (with hoists/cranes) the height of lift.

In its optimum form where strain gauges and micro-switches are employed, with an associated data storage device capable of direct downloading of its information to an appropriate analytical computer, the device of the invention not only provides for signalling at the point that a safe working load is approaching and has been exceed but also enables the storing and analysing of other data such as motor temperature, break wear and operational hours, as has been mentioned earlier. This therefore provides an ability to have full load spectrum analysis instantly available along with accurate information regarding the need to take the equipment out of operations for servicing and refurbishing before damage occurs with an enforced and potentially longer downtime involved.

BRIEF DESCRIPTION OF THE DRAWINGS

Two embodiments of the invention will now be described with reference to the accompanying drawings in which.

DESCRIPTION

Figure 1:
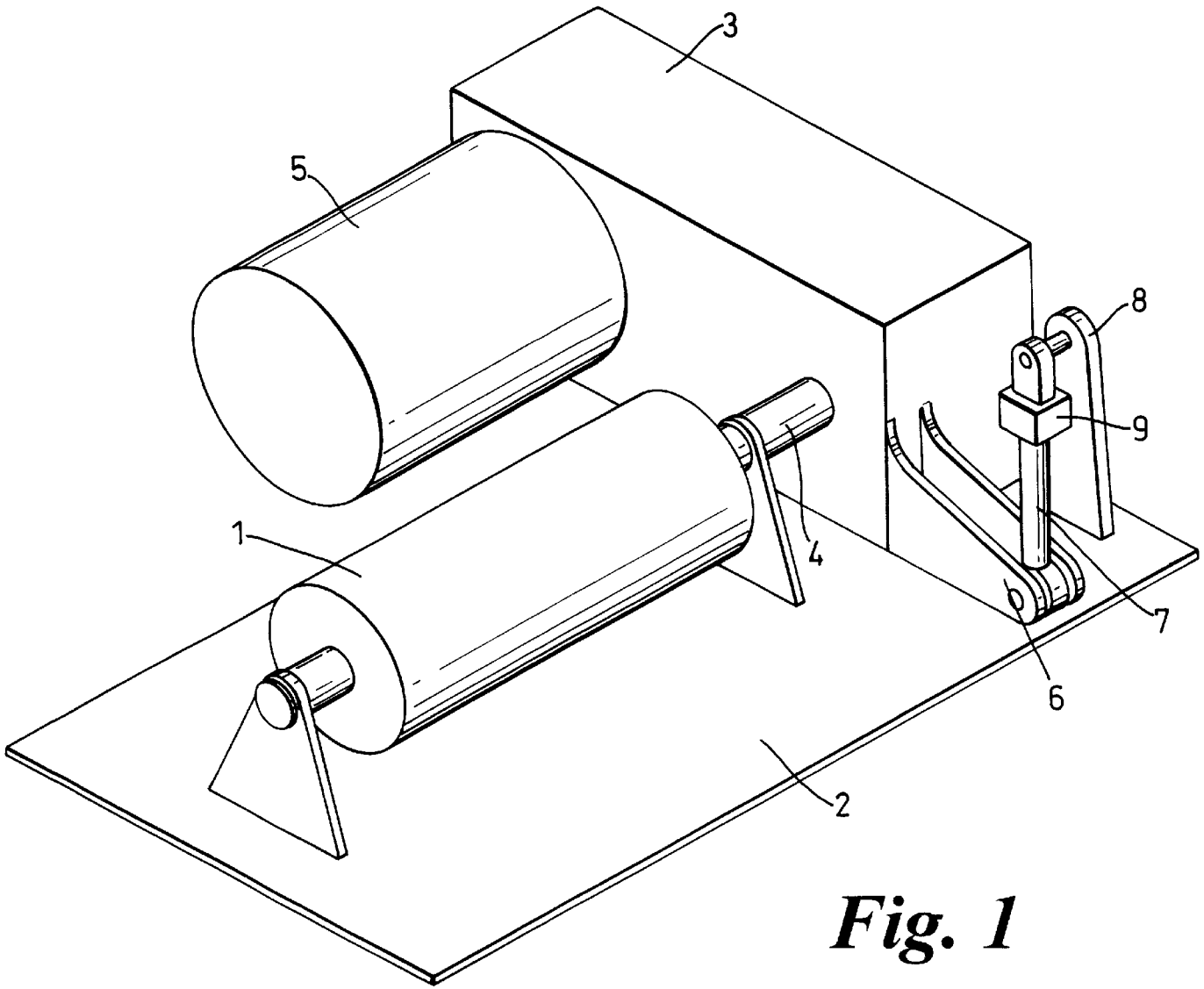
FIG. 1 is a schematic perspective view of the drive roller/drum of a hoist or crane with an associated load monitoring device, according to the invention.

In FIG. 1, a drive roller or drum 1 of a hoist or crane is attached to a mounting plate 2 on which is located an associated gearbox 3, the gearbox 3 having a drive shaft 4 extending to the roller/drum 1. As indicated, the gearbox 3 has an associated drive motor 5.

The gearbox has attached to one side thereof a pair of parallel lever arms 6, between the ends of which a torque arm 7 is pivotally located. The opposite end of the torque arm 7 is pivotally attached to an adjacent rigid structure 8, which may be a post mounted on the base plate 2.

Located on the torque arm is a means 9 able to sense the degree to which the gearbox moves under load.

During use, the motor 5 drives the shaft 4 and hence the roller/drum 1, to wind in or out a rope or chain wound on the roller/drum. The load on the rope/chain and the drive applied by the motor cause a reaction on the gear box, attempting to cause the gearbox to rotate, such tendency to rotate being translated into a movement of the lever arms 6 resisted by the torque arm 7 secured between the lever arms 6 and the rigid structure 8. The greater is the load on the roller/drum 1, the greater is the tendency of the gearbox to rotate about the shaft 4, and the greater is the load on the torque arm 7.

By providing a sensing means on the torque arm, a means of signalling can be provided to advise that the safe working load or design capacity of the hoist/crane has been exceeded.

Figure 2:
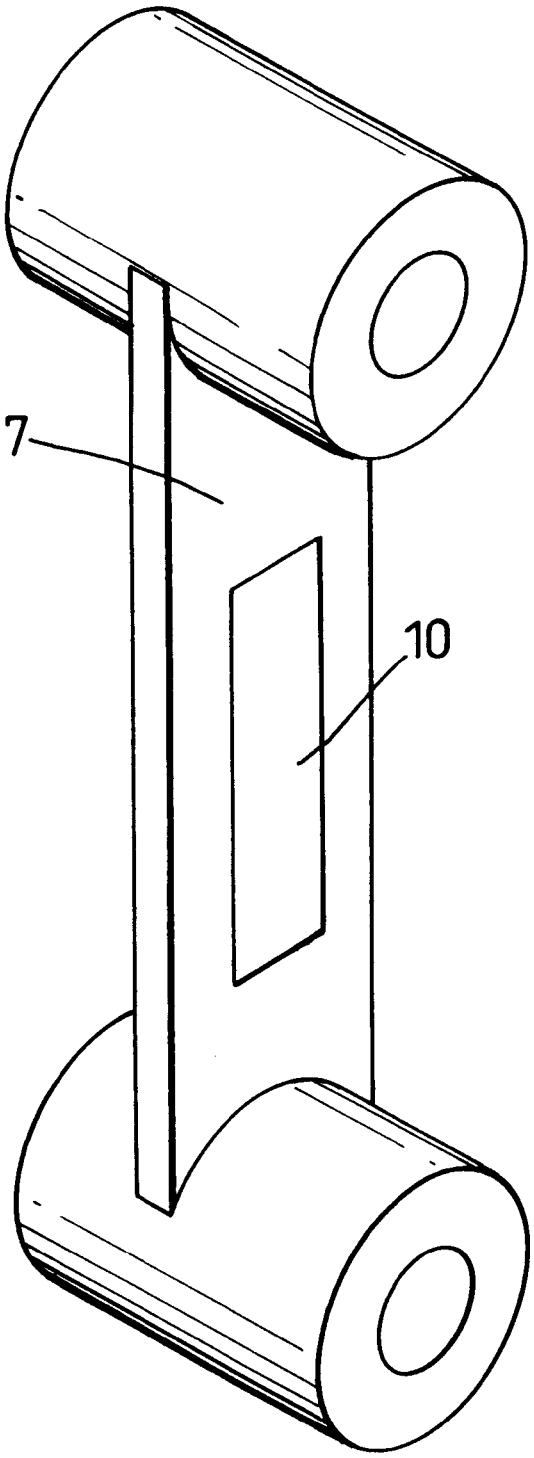
FIG. 2 is a schematic perspective view of a strain gauge capable of use in the construction of FIG. 1.

As indicated by FIG. 2, the torque arm 7 may be formed as a flat plate with pivots at each end to attach the flat bar between the lever arms 6 and the rigid structure 8 of FIG. 1. The flat plate is provided with a strain gauge or load indicator 10 able to provide a signal that is a direct function of the load applied to the flat plate by the movement of the gearbox.

Figure 3:
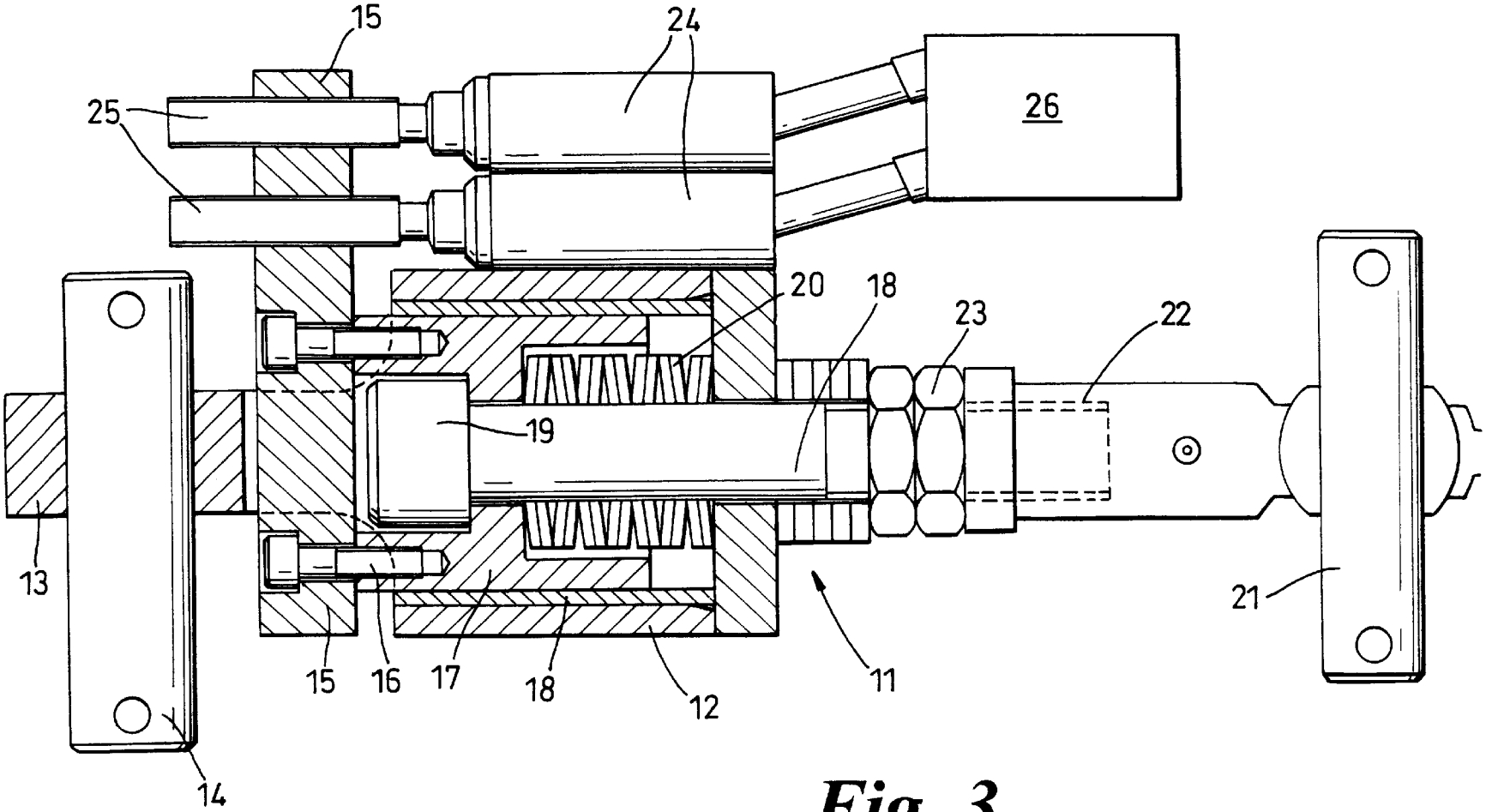
FIG. 3 is a sectional view of a load indicator unit in accordance with the invention.

Preferably, and as is shown by FIG. 3, the means associated with the torque arm is a load indicator unit 11. The unit comprises a body 12 of cast spheroidal graphite iron having a tail 13 with a pivotal connection 14 for attachment to a rigid structure. Located for axial movement in relation to the body 12 and 13 is a crossplate 15 extending through a hole in the tail, the crossplate 15 being attached by high tensile bolts 16 to a steel piston 17 located in the body, the body having a lining 18 of a material of low coefficient of friction such as, for example, PTFE. The piston 17 is located on a rod 18, the rod having a head 19 to engage the piston, and extending through and beyond compression springs 20 in the body, the rod emerging from the body and terminating in a pivotal connection 21 for attachment to the gearbox of a hoist/crane.

The rod 18 has a threaded connection 22 to the end section bearing the pivot 21, whereby to allow an adjustment by way of adjusting nuts 23 of the tension in the springs 20.

Mounted on the body 12 are a number of micro-switches 24 (two illustrated) and on the crossplate 15 are a corresponding number of adjustable contacts 25.

In use, and as has been referred to above, with the unit connected between a gearbox and an adjacent rigid structure, a load on a drive roller or drum of a crane or hoist, causes an attempted rotational movement of the gearbox. As a consequence, the pre-loading of the springs 20 is overcome with a consequent movement of the piston to bring the contacts 25 into engagement with their respective micro-switches 24. By way of an appropriate pre-tensioning of the springs 20 and different settings of the contacts 25, there can be a successive activation of the micro-switches 24 to sense a build up of load on the drive roller or drum, and signal an approach to and an exceeding of a safe working load or design capacity of the hoist or crane.

Desirably, the output from the e.g., strain gauge or load indicator 10, or the micro-switches 24, is directed to an information storage unit or microprocessor 26 as is indicated schematically in FIG. 3.

Such a storage unit or microprocessor may serve the purpose of issuing an audible or visual signal or warning as a safe working load is approached or exceeded, and can incorporate automatic cut out means to prevent the overloading of the hoist or crane. Equally, such a unit can store information to provide an accurate record of the number of times during a predetermined time that the safe working load is approached or exceeded. Equally, other important parameters such as motor temperature, break wear and operational hours can also be recorded and stored, to provide instant access to the full load and working parameters of a load or hoist, from which accurate information is available regarding the need to take a crane or hoist out of service to enable essential servicing and refurbishing of a crane or hoist before any damage is caused creating an unplanned, enforced and potentially longer downtime.

I claim:

1. A monitoring device, for use with a crane or hoist having a drive roller or drum with a drive shaft and a gearbox directly or indirectly attached to aid drive shaft, said monitoring device comprising a means of resisting rotational movement of the gearbox located between the gearbox and an adjacent rigid structure, the said means between the gearbox and the adjacent rigid structure being such as to allow a limited degree of movement of the gearbox, and there being a means to react to said movement of the gearbox associated with the said means of resisting rotational movement.

2. A monitoring device as in claim 1, wherein the said means to react to rotational movement of the gearbox is one or more micro switches to be operated by the rotational movement of the said gearbox.

3. A monitoring device as in claim 1, wherein the said means to react to rotational movement of the gearbox is a strain gauge on or in the said means to resist rotational movement of the gearbox.

4. A monitoring device as in claim 1, wherein the means to resist rotational movement of the gearbox is a torque arm attached at one end to an adjacent rigid structure, and at the other end to the gearbox, at a point on the gearbox distanced from the axis of the driven shaft of the drum or roller.

5. A monitoring device as in claim 4, wherein associated with the connection between the gearbox and the torque arm, and/or between the torque arm and the adjacent rigid structure there are one or more micro-switches, calibrated to react to the load imposed on them by the rotation of the gearbox.

6. A monitoring device as in claim 1, wherein the means to react to movement of the gearbox is connected to a means of emitting a warning signal.

7. A monitoring device as in claim 1, wherein the means to react to movement of the gearbox is connected to an information storage unit or microprocessor.

8. A monitoring device as in claim 7, wherein the storage unit or microprocessor is connected to other signalling means whereby to record and store for analysis other parameters related to the safe functioning of cranes and hoists.

9. A monitoring device as in claim 1, wherein a load indicator unit is provided between the gearbox and the adjacent rigid structure, the unit comprising a cast spheroidal graphite iron body having a means for its pivotal attachment to an adjacent frame, within which is a PTFE lined bushing in which a steel piston is allowed to slide, the piston being connected to a plate associated with an able to activate a number of limit switches via adjusting screws.

10. A monitoring device as in claim 9, wherein behind the piston is a number of disc springs which serve to resist the force applied to the unit.

11. A monitoring device as in claim 9, wherein the piston is connected via a screw to a rod end joint that forms part of the pivot attached to the gearbox.

12. A monitoring device as in claim 1, wherein the torque arm is formed by a nominally flat bar of an appropriate metal provided with pivot forming holes at each end, and there being mounted along the length of the bar one or more strain gauge elements, the output from which is a function of the load on the flat bar.

* * * * *